US006644282B2

(12) United States Patent
Schwarz

(10) Patent No.: US 6,644,282 B2
(45) Date of Patent: Nov. 11, 2003

(54) FUEL INJECTION SYSTEM WITH FUEL PRESSURE INTENSIFICATION

(75) Inventor: Volker Schwarz, Weinstadt (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/308,896

(22) Filed: Dec. 3, 2002

(65) Prior Publication Data

US 2003/0116136 A1 Jun. 26, 2003

(30) Foreign Application Priority Data

Dec. 3, 2001 (DE) ..... 101 58 951

(51) Int. Cl.[7] ..... F02M 37/04
(52) U.S. Cl. ..... 123/467; 123/446
(58) Field of Search ..... 123/467, 446, 123/500, 501, 447, 514

(56) References Cited

U.S. PATENT DOCUMENTS

| | | | | | |
|---|---|---|---|---|---|
| 3,943,901 | A | * | 3/1976 | Takahashi et al. | 123/446 |
| 4,184,459 | A | * | 1/1980 | Ishii et al. | 123/467 |
| 4,449,507 | A | * | 5/1984 | Mayer | 123/467 |
| 4,459,959 | A | * | 7/1984 | Terada et al. | 123/446 |
| 5,622,152 | A | * | 4/1997 | Ishida | 123/446 |
| 5,722,373 | A | * | 3/1998 | Paul et al. | 123/446 |
| 6,345,605 | B1 | * | 2/2002 | Augustin et al. | 123/446 |
| 6,513,497 | B1 | * | 2/2003 | Mahr et al. | 123/447 |

* cited by examiner

*Primary Examiner*—Carl S. Miller
(74) *Attorney, Agent, or Firm*—Klaus J. Bach

(57) ABSTRACT

In an injection system with pressure intensification with a simple and space-saving design, control means are provided permitting a large range fuel injection pressure control, which also permits rapid adaptation of the fuel injection pressure to the various engine operating conditions.

9 Claims, 4 Drawing Sheets

FUEL INJECTION SYSTEM WITH FUEL PRESSURE INTENSIFICATION

BACKGROUND OF THE INVENTION

The invention relates to a fuel injection system with fuel pressure intensification, in which there is arranged, at the transition from a pressure source, which is formed in particular by a pressure accumulator, to a fuel injection injector, a pressure intensifier having a control space whose pressure level determines the degree of intensification and, consequently, the pressure increase over the initial pressure in the pressure accumulator and the operating pressure for the injector. The nozzle needle is loaded in the closing direction by the fuel pressure in a pressure chamber formed at the rear side of the nozzle needle.

In a known system of this type, the control space and also the pressure chamber are connected to a fuel return independently of one another, in each case by way of a control valve so that, by control of the pressure intensifier, a particular shape for the pressure curve can be established. By controlling the injector independently a range of the pressure curve suitable for injection can be selected. A mutually independent control of the pressure intensifier and of the injector is provided by magnetically actuated 2/2-way valves. This requires in addition to space and costs, a highly accurate coordination in the activation of the injectors and the valves since even small tolerances result in marked differences in the injection behavior.

In order to reduce the space requirement and the costs, and also to simplify the control so as to be able to sufficiently affect the engine combustion, in a first solution according to the invention, the connection of the control space and of the actuation space to the fuel return is controlled in a combined manner via a common valve connection. As a result, although the breadth of variation is restricted, the expenses are considerably reduced and space is saved, still wide-ranging possibilities for exerting influence are afforded. That is the combustion behavior of the internal combustion engine can be sufficiently influenced particularly with regard to obtaining favorable exhaust gas values.

A further solution according of the invention utilizes the fuel injector itself as a control element or control valve in that a part, which is involved in actuating the nozzle needle and moveable together with the nozzle needle, is a spool valve, which, by the design of the control cross-section thereof, particular the rising flank of the pressure profile can be varied in relation to the pressure prevailing at the nozzle needle seat.

Finally, in a further solution according to the invention the connection of the control space or of the action space to the return is influenced by a control valve in the form of a pressure balance with connections which branch off, on one hand, from the inlet and, on the other hand, from a connection between the inlet and the connection of the actuator space or of the control space to the return. In this solution, a separate valve control is implemented for connecting the control space and the actuation space to the return, but the control outlay is substantially reduced depending on the hydraulic conditions. The other valve control, which is disposed in the connection of the actuation space or of the control space to the return and which is established via the directional valve, affords the possibility of influencing the hydraulic conditions and consequently the control behavior of the pressure balance by a corresponding timing of the directional valve.

In a preferred design, one of the connections is branched off from the inlet and the other is branched off from a throttled connection between the inlet and the connection of the actuation space to a downstream control valve.

In such a design, the injector and the pressure intensifier are activated virtually simultaneously. A rising pressure profile during injection is thereby ensured.

This, in turn, makes it possible to provide for a process sequence which makes it possible, in particular, to affect the rising ramp of the pressure profile at the nozzle seat and which leads to a virtually rectangular pressure profile, in particular in the region of the rising ramp.

For this process sequence, it is assumed that the closing position of the magnetically activated control valve corresponds to a closing position of the nozzle needle due to the high pressure prevailing in the actuation space and due to the blocking of the control space to the return as determined by the pressure balance. When the magnetically activated control valve, which is in particular a 2/2-way valve, is briefly opened, the pressure drops in the actuation space and, with some delay, also in the control space. As a result, the pressure on the control piston of the pressure balance in the direction of its closing position is reduced. In this intermediate phase, however, the nozzle needle is still closed, so that, in the event of a correspondingly brief opening of the control valve, the pressure in the actuation space is reduced, but not the pressure prevailing at the inflow side, assuming corresponding dimensioning of the throttle cross-sections in the inlet and in the outlet to the actuation space. If, then, the control valve is once again opened, initially the pressure in the action space is reduced along with the high pressure at the inlet side, so that, during the opening of the nozzle needle, a correspondingly steep pressure rise at the nozzle-needle seat, and consequently, a steep pressure ramp, is obtained. This occurs especially since the previous lowering of pressure as a result of the preceding brief opening of the control valve also causes a reduction of the pressure acting on the control spool of the pressure balance in a closing direction. Consequently, when the control valve is once again opened in order to initiate fuel injection, there is a rapid displacement of the control spool of the pressure balance to the opening position connecting the control space to the return line.

In a further design, in which the pressure balance is branched off, on the one hand, from the inflow and, on the other hand, from a throttled connection between the inflow and the connection of the control space to the following control valve, when injection is initiated by opening of the control valve, the pressure intensifier is cut in before the injector is released. The result of this is a high pressure prevailing at the injector when the latter responds, this, in turn, entailing a steep, virtually rectangular pressure profile during injection.

Overall, therefore, in the solutions according to the invention, with only one magnetically activated control valve, an operating behavior is achieved, in which tolerances in the operation of the valve are avoided and the space requirements and also the control requirements are reduced overall, and in which, irrespective of these simplifications, both, fuel preinjection and fuel post injection are possible and the injection pressure is freely selectable.

Further details and features of the invention will become apparent from the following description of the invention with reference to the accompanying drawings:

DESCRIPTION OF PREFERRED EMBODIMENTS

Figure 1:
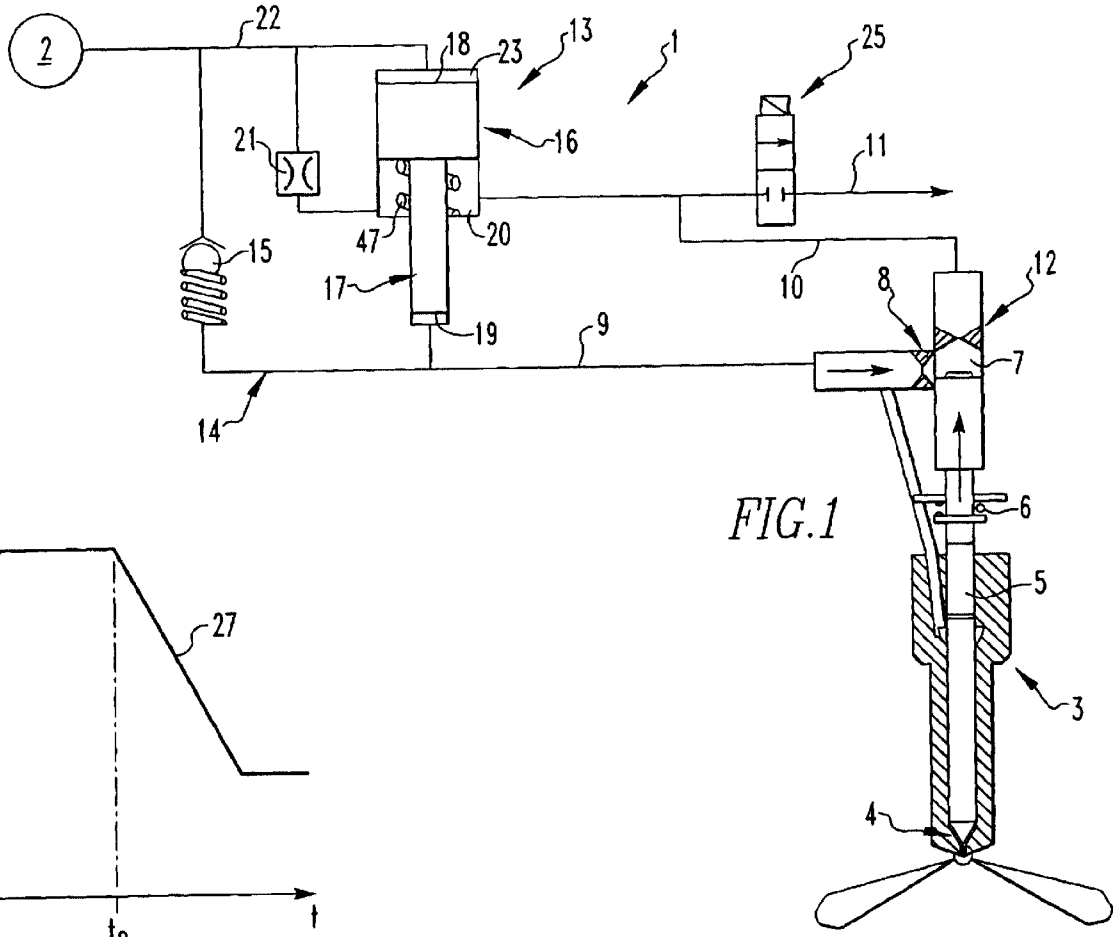
FIG. 1 shows diagrammatically an injection system with pressure intensification, in which the communication between the control space of the pressure intensifier and of the actuation space of the injector is controlled via a control valve.

In the figures, 1 designates an injection system which comprises a pressure source 2 in the form of a pressure accumulator, as is customary, particularly in common rail systems, and a fuel injector 3. The fuel injector 3 is illustrated merely diagrammatically and has a nozzle-needle bore which extends to a nozzle seat 4 which is provided with injection holes and in which a nozzle needle 5 is supported. The nozzle needle 5 is spring-loaded towards it closing position as indicated diagrammatically at 6. At the rear side, an actuation space 7 is provided which is connected in a throttled manner, indicated by a diaphragm or throttle 8, to a fuel supply line 9 and which also has a connection 10 to the fuel return 11. A throttle 12, which may also be in the formal a diaphragm, is provided at the transition between the actuation space 7 and the connection 10.

A pressure intensifier 13 is connected to the fuel supply line 9 from the pressure source 2 to the fuel injector 3, specifically in the portion 14 of the fuel supply line 9 and a non-return valve 15 is disposed in the line portion 14.

The pressure intensifier 13 comprises a stepped piston arrangement including a pressure receiver 16 and a pressure transmitter 17. The pressure receiver 16 has a larger action surface 18 than the pressure transmitter 17, the action surface of which is designated by 19.

Opposite the action surface 18, the pressure receiver 16 includes a control space 20 in which a spring 47 is disposed. The control space 20 is connected in a throttled manner, illustrated symbolically by the throttle 21, to the inflow line 22 between the pressure source 2 and the working space 23 over the action surface 18 of the pressure receiver 16.

The control space 20 is in communication by a line 24 to the fuel return 11. The communication line 24 from the control space 20 to the return 11 extends to the return 11 by way of a control valve 25 which is a magnetically controlled 2/2-way valve. Also, the fuel injector 3 is connected to the line 24 so that the control space 20 and the fuel injector, that is the actuation space 7 thereof, can be in communication with the return line 11 under the control of the valve 25.

In the illustrated initial position of the control valve 25, the lines 10 and 24 which lead to the return 11 are blocked with the result that the pressure intensifier 13 is not activated and the nozzle needle 5 is held in its closed position by the pressure maintained in the actuation space 7.

When the control valve 25 is opened, the control space 20 and also the actuation space 7 are simultaneously connected to the return 11 and are consequently relieved of pressure. As a result, the pressure intensifier 13 is activated and the nozzle needle 5 is raised into the opening position via the injection medium, which is present under high pressure. With the pressure intensifier 13 interposed, the pressure prevailing on the inlet side via the pressure source 2 is increased so that, depending on the degree of intensification, very high injection pressures are available. The pressure intensification however is restricted to that part of the injection medium, which flows to the fuel injector 3. The response times in the connection between the control space 20 and the return 11 or respectively, between the actuation space 7 and the return 11 can be influenced via the respective flow cross sections, as illustrated for the line 10 by the throttle 12.

Figure 2:
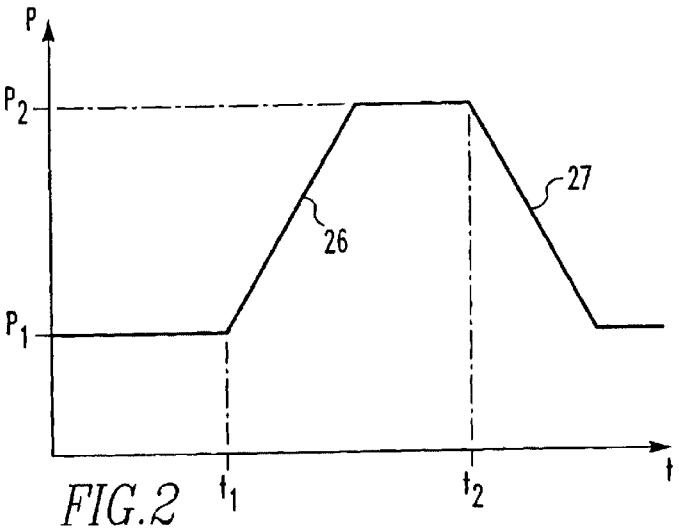
FIG. 2 is a diagrammatic illustration of the pressure profile at the nozzle-needle seat over time.

FIG. 2 illustrates the profile of the pressure P at the nozzle-needle seat 4 over time, t, $P_1$ designating the pressure provided by the pressure source and $P_2$ designating the pressure which prevails at the inlet side during activation of the pressure intensifier 13. $t_1$ designates the point in time of the opening of the control valve 25 and $t_2$ its subsequent closing point of time. The opening-side ramp of the pressure-profile curve is designated by 26 and the ramp occurring during closing is designated by 27. A steeper or flatter profile of the ramps 26, 27 is obtained as a function of the pressure reduction in the actuation space 7 and of the level of the high pressure prevailing on the inlet side. It is the aim to have a steep, preferably virtually rectangular profile particularly at the opening side.

Figure 3:
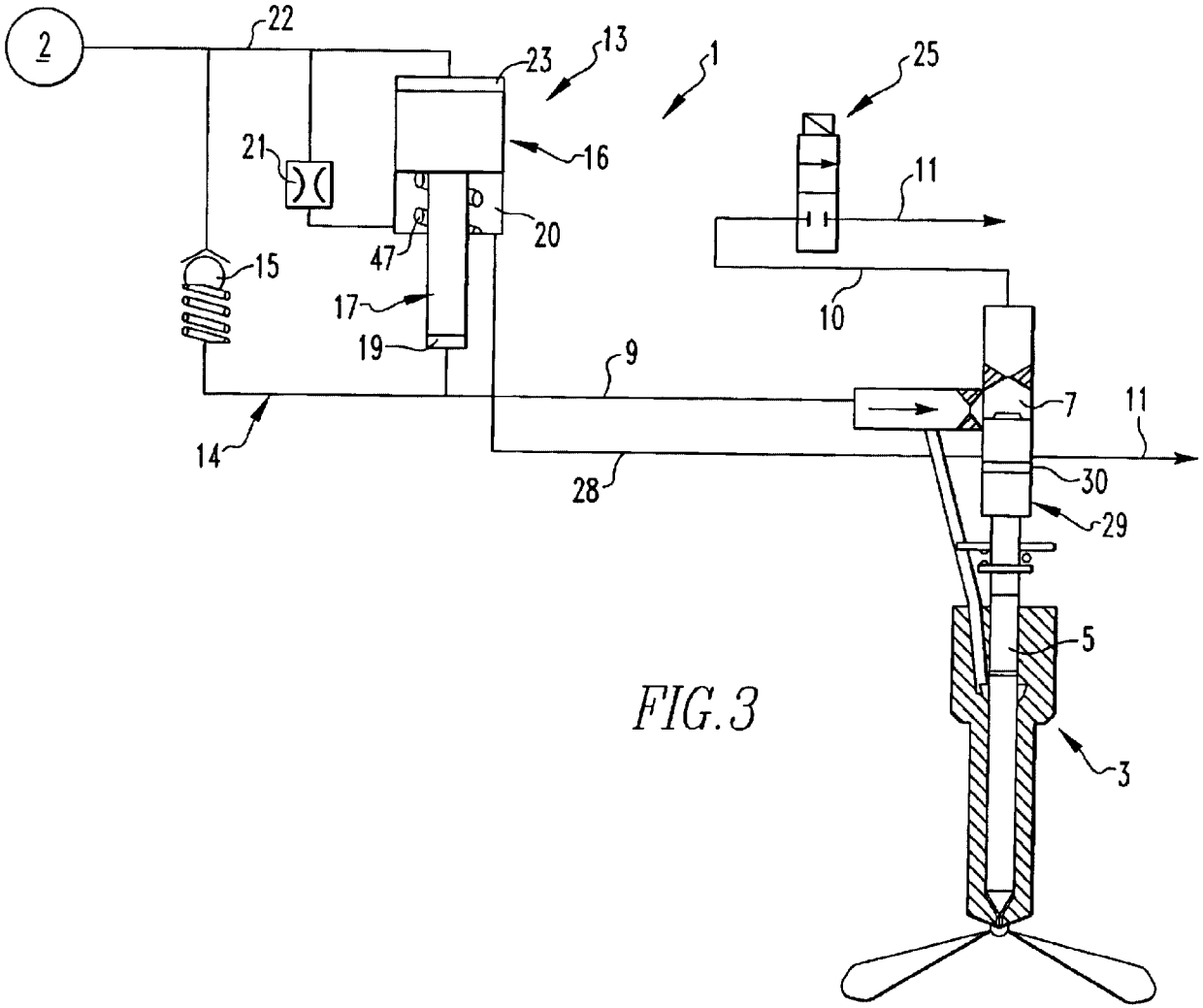
FIG. 3 shows an embodiment of an injection system with pressure intensification wherein the stroke movement of the nozzle needle of the fuel injector is utilized for controlling communication between the control space of the pressure intensifier and the fuel return.

FIG. 3 shows another embodiment, corresponding parts or connections being given the same reference numerals.

Contrary to the illustration according to FIG. 1, the connection from the control space 20 to the return 11 designated by 28 extends to a control spool 29, which is an integral part of the nozzle needle operating mechanism disposed above the actuation space 7 of the nozzle needle 5 and which delimits the actuation space 7 at on the nozzle-needle side. The control spool 29 has a control groove 30 for controlling the fuel flow to the return 11.

Via the control groove 30 and its position in relation to the connection cross sections of the connection 28 to the injector 3, the control times can be adjusted. The control groove 30 may also form a throttle cross-section.

Figure 4:
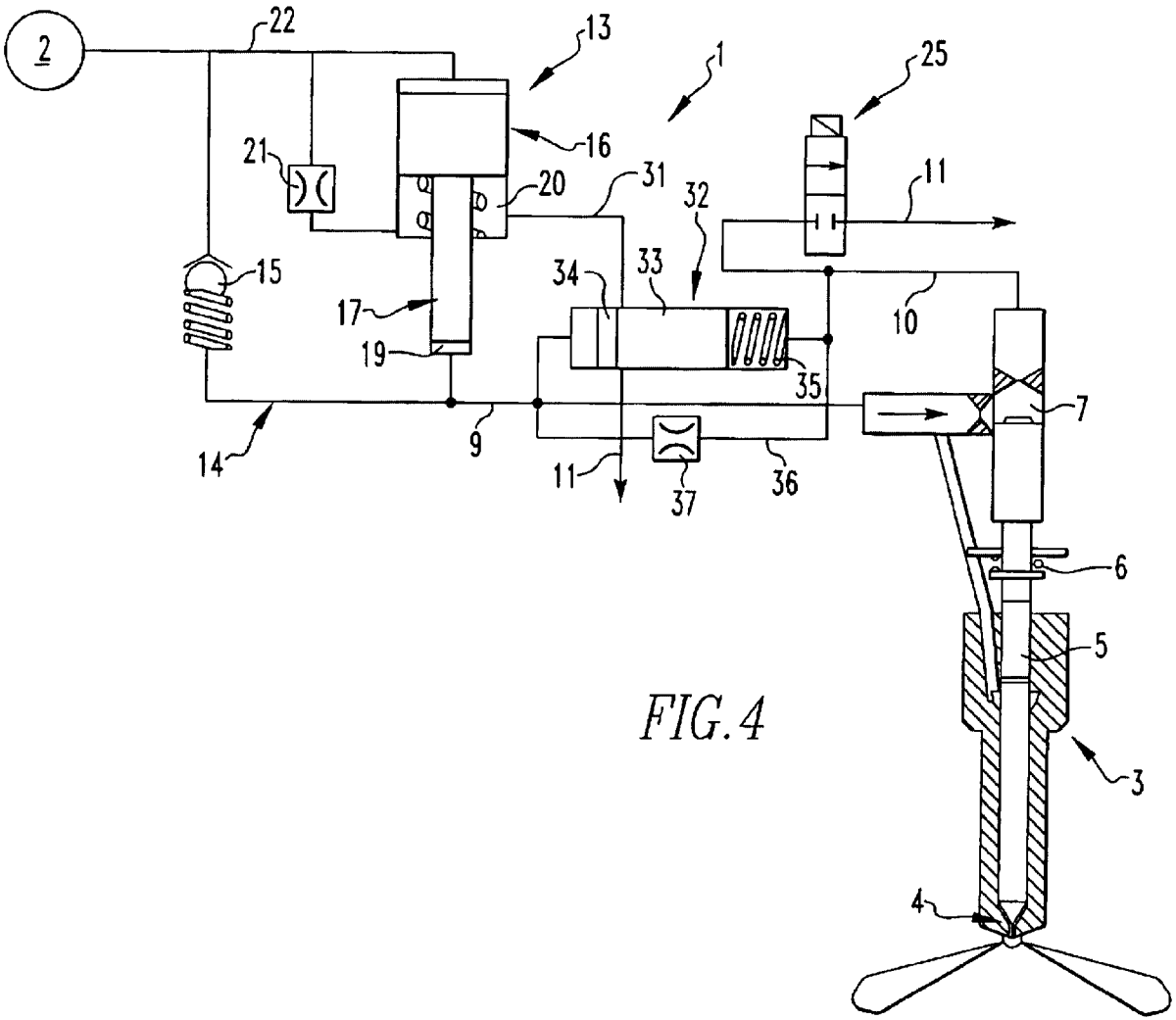
FIGS. 4 and 5 show other embodiments of an injection system with pressure intensification according to the invention, in which communication between the control space of the pressure intensifier or the communication between the actuator space of the fuel injector and the return are controlled via a pressure balance.

In the embodiment according to FIG. 4, as in the previous versions, the control valve 25 is disposed in the connection line 10 to the return line 11. The connection line 31 between the control space 20 and the return line 11 extends through a pressure control valve 32 containing a control spool 33, which has a control groove 34 and which is spring-biased toward one end position by a spring 35. The pressure control valve 32 is connected, at the end opposite the spring 35, to the fuel supply line 9, and a throttled connection 36 extending via the throttle 37 from the inflow 9 to the connection line 10 of the actuation space 7 to the return line 11. The connection for that end of the control spool 33, which is acted upon by the spring 35, is branched off from the connection 36. Depending on the pressure, the control groove 34 is in alignment with the connection 31 of the control space 20 providing for connection with the return 11 or alternately blocking off this connection.

When the control valve 25 is opened, the pressure in the actuation space 7 and also the spring-side action of pressure on the control spool 33 of the pressure control valve 32 drops, so that the pressure intensifier 13 is activated. The corresponding time sequences can be influenced in a more or less throttling manner by means of appropriate connection line cross sections. A corresponding influence is also possible by the timing of the control valve 25, for example such that the latter is first opened briefly, so that the pressure in the action space 7, is lowered but the nozzle needle 5 does not lift off the nozzle seat 4. When the control valve 25 is re-opened after a brief closing phase, an initial period is provided in which there is a lower pressure in the actuation space 7 and therefore the high pressure built up via the pressure intensifier 13 acts upon the nozzle needle 5 against a lower counter-pressure thus leading to a virtually immediate opening of the nozzle needle 5 along with a correspondingly steep pressure rise at the nozzle seat 4.

Figure 5:
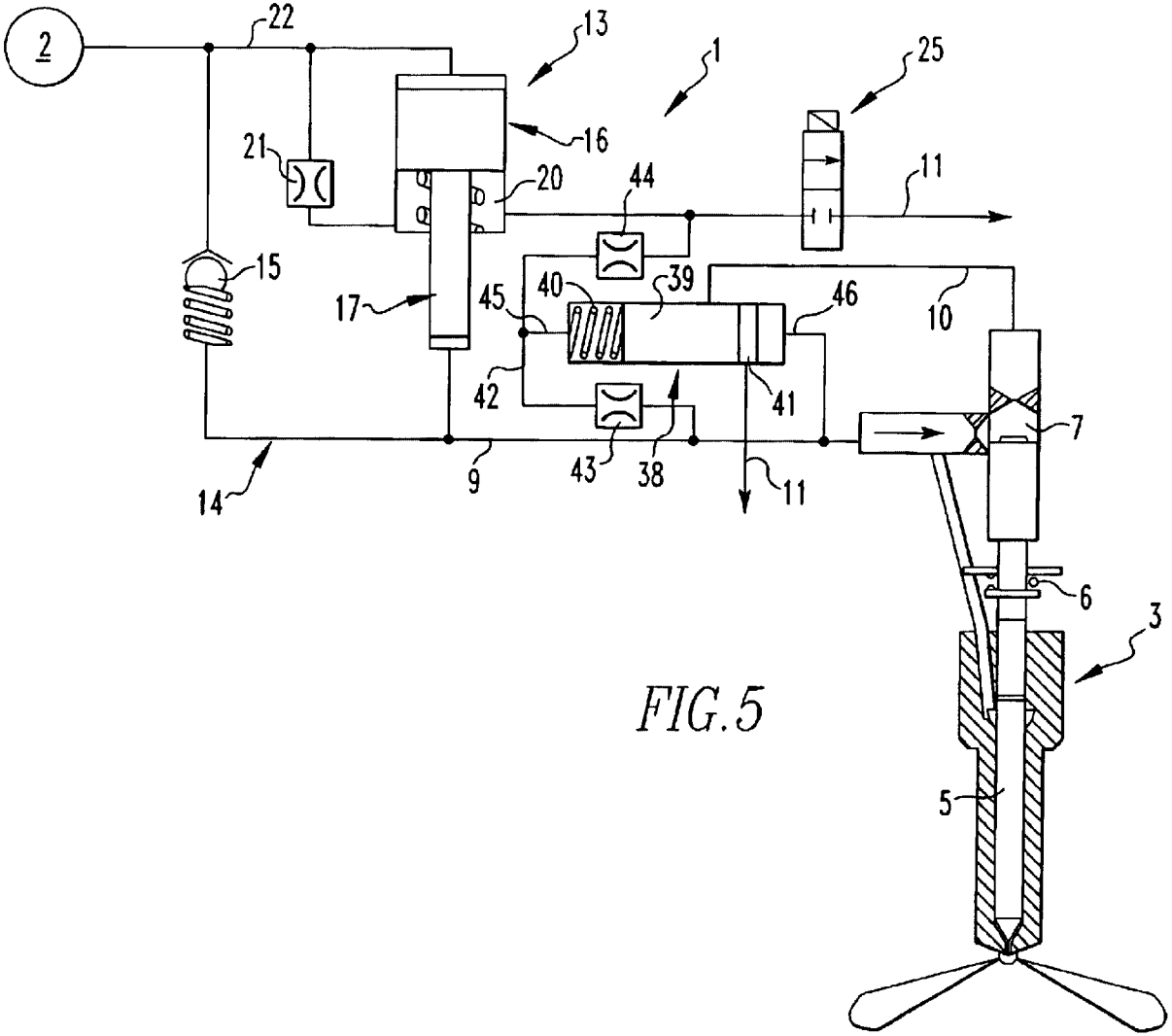

In the embodiment according to FIG. 5, once again a pressure control valve 38 is used for operation, the valve having a control spool 39 which is biased towards one end position via a spring 40 and which has a control groove 41.

The control space 20 of the pressure intensifier 13 is connected to the return line 11 via the connection line 24 and the control valve 25. The pressure control valve 38 is disposed between the inlet line 9 and the connection line 24 extending from the control space 20 to the return 11. The spring-side end of the pressure control valve 38 is connected to a connection line 42, which extends to the inlet line 9 via a throttle 43 and to the connection line 24 via a throttle 44. The connection 45 to the spring side of the pressure control valve 38 is branched off between the throttles 43 and 44. The opposite connection designated by numeral 46 is connected, unthrottled to the inlet line 9. In this embodiment, during the opening of the valve 25, the pressure intensifier 13 is first activated and there is a relatively small delay in the response of the injector 3, so that, at the start of injection, a high pressure is rapidly available at the nozzle needle 5 and an approximately rectangular profile of the pressure curve is obtained.

What is claimed is:

1. An injection system operating with pressure intensification, comprising: a fuel injector (3), a pressurized fuel source (2) for supplying fuel to said fuel injector (3), said fuel injector (3) including a nozzle needle (5) having a tip and an actuation space (7) disposed at the rear end of said nozzle needle (5) remote from the tip thereof and being connected to an inlet line (9, 14) extending from said pressurized fuel source (2) and also to a fuel return (11), said injection system having a fuel inlet line portion (14) with a non-return valve (15) preventing fuel return to the pressure source (2), a pressure intensifier (13) in communication with said inlet line (9) and comprising a fuel receiver (16) in communication with said fuel source (2) and a pressure transmitter (17), which has a working surface (19) smaller than the working surface (18) of said fuel receiver (16) and which is connected to the inlet line (9) to the actuating space (7) of the fuel injector (3), said pressure intensifier (13) including a spring (47) providing a force on the pressure receiver (16) which biases the pressure receiver (16) in the direction toward said pressure fuel source (2), a throttled connecting line (22) extending from said fuel source (2) to a control space (20) at the surface of the pressure receiver opposite the working surface (18) thereof, the control space (20) and the actuation space (7) being connected to the return line (11) by way of a common control valve (25).

2. An injection system operating with pressure intensification according to claim 1, wherein said common control valve (25) is a 2/2-way valve.

3. An injection system operating with pressure intensification, including a fuel injector (3) supplied with an injection fuel from a pressure source (2), said fuel injector (30) comprising a nozzle needle (5) with a tip and an actuation space (7) disposed at the rear end of said nozzle-needle (5) opposite the tip thereof and connected to a fuel inlet line (9, 14) extending from said pressure source (2) and in a throttled manner to a fuel return line (11), said fuel inlet line (9, 14) including a portion (19) with a non-return valve (15) disposed in said portion, a pressure intensifier (13) comprising a pressure receiver (16) and a pressure transmitter (17) having a smaller working surface (19) than said pressure receiver (16) and being connected to said inlet line (9) extending to said actuation space (7), said fuel pressure intensifier (13) including a spring (47) biasing said pressure transmitter (17) against the pressure source (2), a connection with a throttle (21) extending from said pressure source (2) to a control space (20) provided at the opposite surface of the pressure receiver (16), the control space (20) and the actuation space (7) being both connected to a return line (11) individually by way of control valves (25, 29), one of said control valves (29) for the connection of the control space (20) to the return line (11) being a spool valve (29) disposed on the nozzle needle (5) and the other control valve (25) for controlling the fuel flow from the actuation space (7) of the fuel injector (3) being an electrically operated value (25).

4. An injection system operating with pressure intensification according to claim 3, wherein said nozzle needle (5) includes a control spool (29) forming a valve with a control piston of said fuel injector (3), said control piston delimiting the actuation space (7) on the nozzle-needle side.

5. An injection system operating with pressure intensification, including a fuel injector (3) receiving fuel from a pressure source (2), and including a nozzle needle (5) with a tip and an actuation space (7) disposed on the rear side of said nozzle needle (5) opposite said tip, said actuation space (7) being connected to an inlet line (9) extending from said pressure source (2) and also in a throttled manner to a return line (11), said injection system having disposed, in a section (14) of the inlet line (9) leading to sail fuel injector (3), a non-return protection valve (15), a pressure intensifier (13) comprising a pressure receiver (16) connected to said pressure source (2) and a pressure transmitter connected to said fuel inlet line (9) and having a working surface smaller than that of said pressure receiver (16) said pressure intensifier (13) including a spring (47) biasing said pressure receiver (16) with its working surface in a direction opposite to said pressure transmitter and toward the pressure source (2), a fuel connection line with a throttle (21) extending to a control space (20) at the side of the pressure receiver (16) opposite said working surface thereof, said control space (20) and said actuation space (7) being individually connected to said return (11) by separate control valves (25, 32), one (25) off said control valves (25, 32) being connected by a connecting line (10) to said actuation space (7)and the other control valve (32) disposed in the connection line (31) or the control space (20) and said return (11) and comprising a control spool (33) connected for pressure control to a connection line branched off from the inlet line (9) and, respectively, a connection line extending between the connection line (10) off the other control valve (25) and the actuation space (7) of the injector (3).

6. An injection system operating with pressure intensification according to claim 5, wherein of the connection lines of the pressure control valve (38) disposed in the connection line (31) of the control space (20) to the return line (11), one line extends from the inlet line (9) and the other from a throttled connection line (10) extending between the inlet line (9) and the connection line (10) off the actuation space (7) and the control valve (25) which is arranged downstream of the actuation space (7).

7. An injection system operating with pressure intensification according to claim 6, wherein the control spool (33)

of the pressure control valve (32) is spring-biased towards its connection to the inlet line (9).

8. An injection system operating with pressure intensification according to claim 5, wherein of the connection line of the pressure control valve (32) disposed in the connection of the control space (20) to the return line (11), one connection line extends from the inlet line (9) and the other from a throttled connection between the inlet line (9) and the connection line (10) of the actuation space (7) to the control valve (25).

9. An injection system operating with pressure intensification according to claim 8, wherein the control spool (33) of the pressure control valve (32) is spring-biased towards its connection to the inlet line (9).

* * * * *